United States Patent [19]

Maestri

[11] Patent Number: 4,864,739

[45] Date of Patent: Sep. 12, 1989

[54] INTERNAL BOOT SOLE

[75] Inventor: Robert Maestri, Saint Julien, France

[73] Assignee: Salomon S.A., Annecy Cedex, France

[21] Appl. No.: 25,764

[22] Filed: Mar. 13, 1987

[30] Foreign Application Priority Data

Mar. 14, 1986 [FR] France ..... 86 04126

[51] Int. Cl.[4] ..... A43B 13/38; A43B 13/41

[52] U.S. Cl. ..... 36/43; 36/31; 36/44; 36/117; 36/127; 128/581; 12/146 M

[58] Field of Search ..... 36/44, 43, 117, 127, 36/31, 91, 71; 128/584, 585, 581; 12/146 M

[56] References Cited

U.S. PATENT DOCUMENTS

| | | | |
|---|---|---|---|
| 3,594,929 | 7/1971 | Stohr | 36/44 |
| 4,364,189 | 12/1982 | Bates | 36/31 |
| 4,372,062 | 2/1983 | Tringali | 36/120 |
| 4,627,177 | 12/1986 | Meyers | 36/43 |
| 4,682,425 | 7/1987 | Simmons | 36/44 |

FOREIGN PATENT DOCUMENTS

| | | | |
|---|---|---|---|
| 2709546 | 9/1978 | Fed. Rep. of Germany | 36/44 |
| 2751146 | 5/1979 | Fed. Rep. of Germany | 36/31 |
| 3306425 | 8/1984 | Fed. Rep. of Germany | 36/43 |

*Primary Examiner*—James Kee Chi

*Attorney, Agent, or Firm*—Pollock, Vande Sande & Priddy

[57] ABSTRACT

An inside boot sole, comprising separate support zones distributed under the surface of the foot, at least two support zones (3, 4) having different mechanical characteristics and each extending at most from the heel (5) to the front end (6) of the sole on both sides of the dividing line (10) located near the median longitudinal axis (7) of the sole.

5 Claims, 2 Drawing Sheets

INTERNAL BOOT SOLE

FIELD OF THE INVENTION

This invention pertains to inside boot soles and especially soles intended to absorb shocks and transmit pressure from the foot to the outside sole.

PRIOR ART

In a known manner, inside soles of this type are either connected to the outside sole or can be removed therefrom. For the first embodiment, one can cite as examples the inside soles as disclosed in German Pat. No. 1.916.935, U.S. Pat. No. 2,055,072 or British Pat. No. 892.156. In these patents, the inside soles are connected to the outside sole and are provided with arrangements intended to absorb shocks and/or make the supports for the foot in the zones where pressure is greatest more comfortable. For the second embodiment, French Pat. No. 1.078.079 and German Pat. Nos. 3.225.550 and 3.306.425 describe removable inside soles also comprising such arrangements.

In all of these cases, the arrangements of the support zones for the foot correspond to the practice of walking and/or running and are as such located under the front part of the foot and under the heel, on both sides of the longitudinal axis of the foot. With the evolution of certain athletic practices such as cross country skiing, in which techniques called the skater step or half step tend to be necessary in competition, it was noted that foot supports more offset with respect to the longitudinal axis of the latter and the type of sole mentioned above are most suitable.

SUMMARY OF THE INVENTION

The invention proposes an inside sole allowing a more effective transmission of the lateral pressures of the foot oriented more especially towards either of the lateral sides of the boot according to the execution of sports in which the main support of the foot is lateral, from the outside (golf) or the inside (skater half step and step in cross country skiing).

According to the invention, the inside sole comprises two separate support zones located on both sides of a line close to its median longitudinal axis which can surround the support surface of the heel. These support zones are each made up of materials having different mechanical properties, such as, for example, hardness, density, elasticity, shock absorbency, etc.

According to a first embodiment of the invention, each support zone is comprised of a single element made of a material different from that used for the other support zone, the two elements being mutually juxtaposed from or beginning with the heel, essentially on the longitudinal median axis of the sole thus comprised or extending diagonally from the heel.

A second embodiment consists of using a single material for the sole and modifying its mechanical characteristics only in one of the support zones, for example, by changing the density of this material, using a heating and/or crushing process applied to said zone.

A third embodiment involves the incorporation of several support elements in the sole, from or beginning with the heel, on only one side of its median longitudinal axis and distributed from the heel up to the front end.

The most shock absorbent support zone of the sole according to the invention may be on the inside or the outside of the foot. As such, for example, for cross country skiing using the skater half step, the inside support zone for the foot will advantageously be firmer to prevent any hysteresis between the repeated pressing movements of the foot on the latter and the ski.

Advantageously, the sole is removable, so that, for example, a given cross country ski boot may be adapted either for the "alternating step" with a conventional inside sole, or for the "skater half step", with the sole according to the invention.

BRIEF DESCRIPTION OF THE DRAWINGS

The invention will be understood more clearly in referring to the description which follows in reference to the attached schematic drawings presenting several embodiments of the sole, as non-limitative examples.

DESCRIPTION OF PREFERRED EMBODIMENTS

Figure 1:
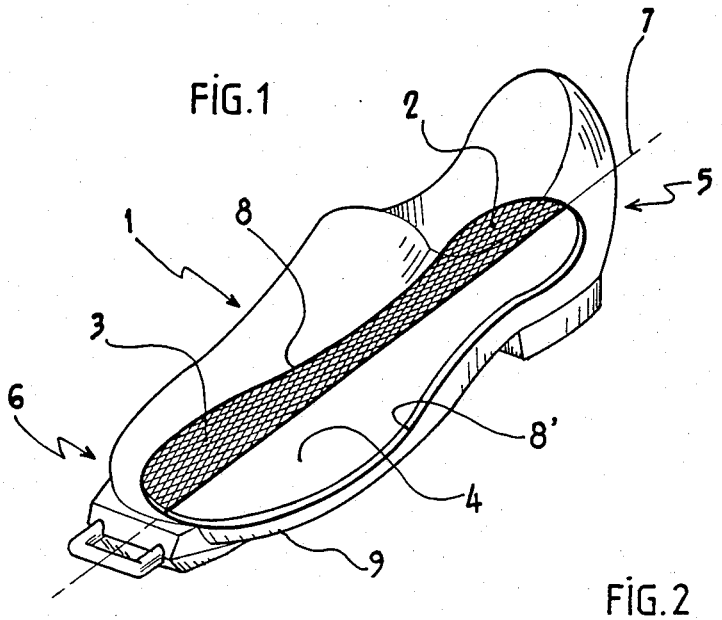
FIG. 1 is a schematic perspective view of a cross country ski boot of a known type, equipped with a sole according to the invention.

FIG. 1 shows a cross country ski boot of a known type provided with an inside sole 2, which is the object of the invention. The surface of the sole 2 is separated into two different support zones, respectively 3 and 4, which each extend from the heel 5 to the front end 6 of said sole on both sides of its longitudinal median axis 7 respectively up to its corresponding lateral edges 8 and 8'. In this embodiment, the support zone 3 having the lowest degree of hysteresis is advantageously arranged on the inside of the foot where the repeated pressure is greatest.

Figure 2:
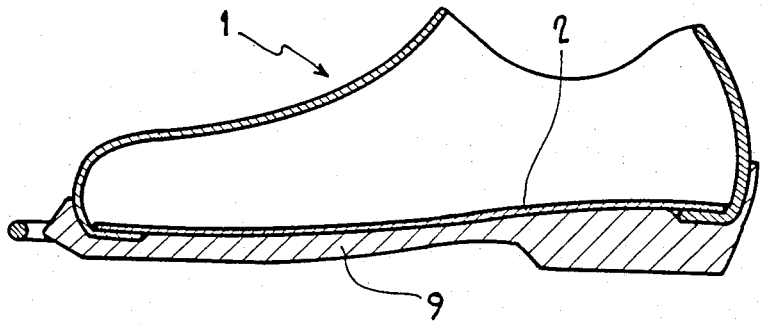
FIG. 2 is a longitudinal cross section of the boot in FIG. 1.
Figure 3:
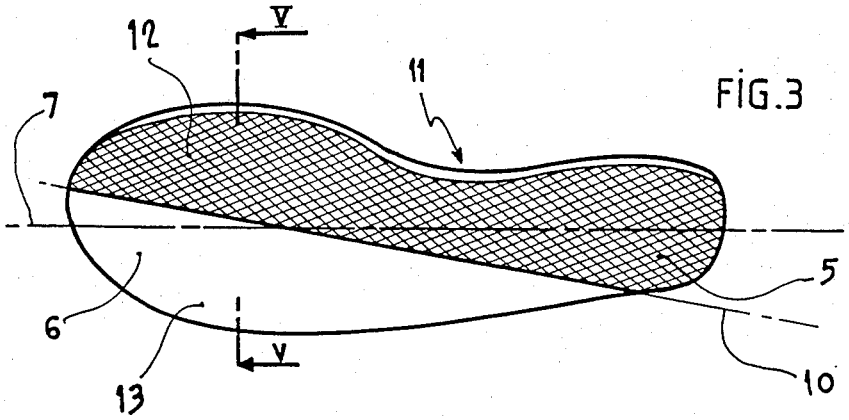
FIGS. 3 and 4 are perspective views of two removable inside soles assembled according to two different processes, still according to the invention.
Figure 4:
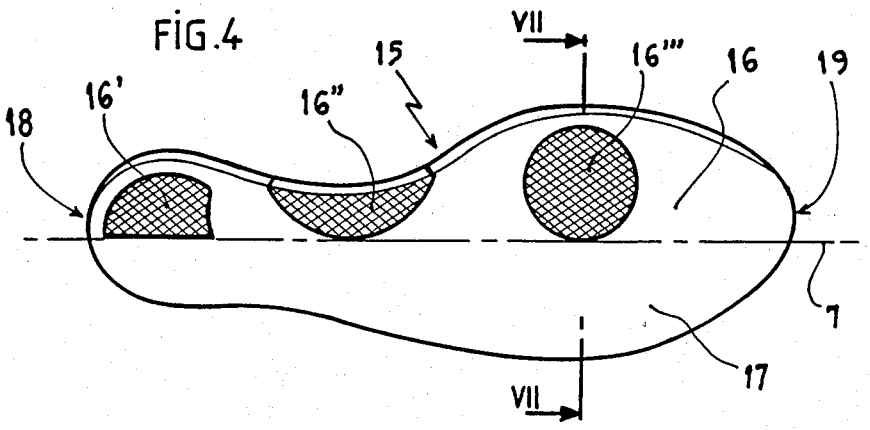
Figure 8:
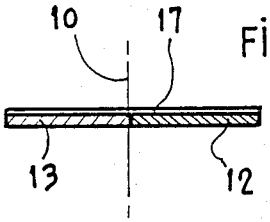

This type of sole 2, (FIGS. 1 and 2) can obviously be connected to the external sole 9 of the boot 1 using any means or process, such as by gluing, soldering, connecting pieces, etc. In the case of a fixed assembly, the support zones 3 and 4 can be made independently of each other and simply juxtaposed along the median longitudinal axis 7 to form the inside sole 2. FIGS. 3 and 4 illustrate two versions of removable inside soles ensuring interchangeability with a conventional-type sole or their replacement in case of wear. In the case in FIG. 3, the removable sole 11 will preferably be made of a single piece, with the support zones 12 and 13 in this case being assembled together by their common edges juxtaposed according to line 10, as can be seen in FIG. 8. In this example, the two support zones 12 and 13 extend along a line 10 diagonally secant to the longitudinal median axis 7 of the sole, so that, in the rear part of said sole, the support zone 12 totally covers the heel zone 5.

Figure 5:
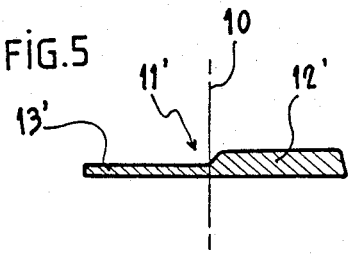
FIGS. 5 and 6 are cross section views of the sole in FIG. 3 seen along line V—V, illustrating the embodiment of the support zone of the latter.
Figure 6:
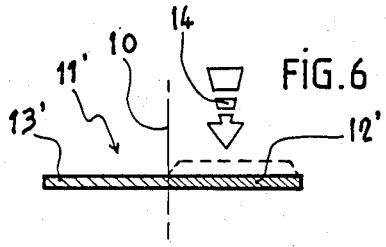
Figure 7:
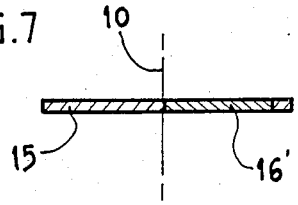
FIGS. 7, 8 and 9 are cross sections of the sole in FIG. 4, seen along line VII—VII, showing two possible embodiments.

According to another embodiment of the sole according to the invention, said sole is comprised of a single material having densities which can vary according to the support zones. In this case, a special treatment, which is known per se, makes it possible to modify the characteristics of one zone as compared with another, using this same material. FIGS. 5 and 6 show a section along line V—V in FIG. 3 of a sole 11' before and after this type of modification. In FIG. 5, the sole 11' before treatment has an asymmetric profile with respect to the line of differentiation 10, with the part 12' being, in this example, relatively more voluminous than the part 13', but having the same density. In this case, it suffices (FIG. 6) to act on this part 12' using a pressing and/or thermal compacting process (shown by arrow 14) to bring it essentially to the level of the part 13; this involves a modification of the density of part 12; and thus of its shock absorbent characteristics. Obviously, the distribution of the support zones 16, 17 of the sole according to the invention can be different and limited to support surfaces having a low degree of hysteresis located exclusively on either side of a dividing line 7 of the supports of the sole, essentially longitudinally with respect to the latter. Indeed, in the embodiment illustrated in FIG. 4, the inside portion of the sole comprises several support zones 16', 16'', 16''' distributed from the heel zone 18 up to the front part 19 of the sole 15. These support zones 16' are comprised of elements made of highly shock absorbent materials, such as low-hysteresis foams, which can be included in the sole 15 (FIG. 7), by duplicate molding for example, or themselves be made to be removable from said sole.

It will be noted that according to the invention, the various shock absorbent support 16' zones are essentially located in the inside portion 16 of the sole, limited essentially by the longitudinal median line 7 of said sole, for a cross country ski boot intended for executing the skater step, in which the skier's pressing actions on the ground are also essentially oriented at the level of the inside surface of the foot.

Figure 9:
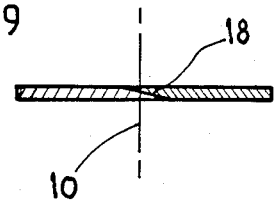

On the other hand, in order that the difference in the nature of the supports at the level of the dividing line are not felt as being too pronounced, the connecting edges between the different support zones will be advantageously bevelled, as shown at 18 (FIG. 9).

Figure 10:
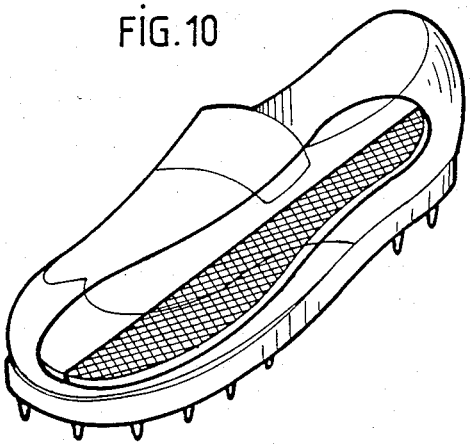
FIG. 10 illustrates the application of the sole according to the invention to a golf shoe.

Finally, to adapt the inside sole according to the invention to a golf shoe, for example, the distribution of the lines of support on this sole will be so arranged that the shock absorbent portion is located substantially on the external side of the foot (FIG. 10).

Obviously, the inside sole may also comprise an additional comfort covering, such as a "clean insole" 17 (FIG. 8) intended to come into contact with the foot.

What is claimed is:

1. Inside boot sole having a front end, a heel end and a median longitudinal axis, said sole comprising first and second support zones distributed under a surface of a foot of a wearer, said support zones having different mechanical characteristics and extending on opposite sides of a dividing line which extends diagonally secant to said longitudinal axis of said sole, said first support zone disposed on an inner side of said sole being made of a first, shock absorbent material having a lower hysteresis than a second material comprising said second support zone disposed on an outer side of said sole, said second support zone extending over only a portion of the distance from said front end toward said heel end, and said first support zone totally covering said heel end.

2. Inside boot sole according to claim 1, wherein said first and second support zones are comprised of first and second support elements made of said first and second materials in assembled form.

3. Inside boot sole according to claim 1, wherein said sole is made of a single material whose density is modified in one of said support zones.

4. Inside boot sole according to claim 3, wherein the density of said first support zone is modified by thermal compacting.

5. Inside boot sole according to claim 3, wherein the density of said first support zone is modified by pressing.

* * * * *